US006041790A

United States Patent [19]

Smith et al.

[11] Patent Number: 6,041,790

[45] **Date of Patent: *Mar. 28, 2000**

[54] CIGARETTE SUBSTITUTE ARTICLE AND METHOD OF MAKING THE SAME

[75] Inventors: Mickey Lee Smith, Winston-Salem; Cynthia Stewart Stokes, Lexington; Ronald Odell Wagoner, Winston-Salem, all of N.C.

[73] Assignee: R.J. Reynolds Tobacco Company, Winston-Salem, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/736,718

[22] Filed: Oct. 25, 1996

Related U.S. Application Data

[63] Continuation of application No. 08/344,197, Nov. 23, 1994, abandoned.

[51] Int. Cl.[7] ..... A24B 1/00

[52] U.S. Cl. ..... 131/360

[58] Field of Search ..... 131/331, 335, 131/337, 360, 270, 273, 297, 298

[56] References Cited

U.S. PATENT DOCUMENTS

| | | | |
|---|---|---|---|
| H1271 | 1/1994 | Shouse | 131/360 X |
| 2,342,853 | 2/1944 | Furstenberg . | |
| 3,347,231 | 10/1967 | Chang . | |
| 3,390,686 | 7/1968 | Irby, Jr. et al. . | |
| 3,540,456 | 11/1970 | McGlumphy | 131/337 |
| 3,623,489 | 11/1971 | Quinn | 131/337 X |
| 3,683,936 | 8/1972 | O'Neil, Jr. . | |
| 4,284,089 | 8/1981 | Ray . | |
| 4,768,526 | 9/1988 | Pryor | 131/335 |
| 4,774,971 | 10/1988 | Vieten . | |
| 4,793,366 | 12/1988 | Hill . | |
| 4,800,903 | 1/1989 | Ray et al. . | |
| 4,807,648 | 2/1989 | Breckwoldt . | |
| 4,813,437 | 3/1989 | Ray | 131/270 X |
| 4,862,905 | 9/1989 | Green, Jr. et al. . | |
| 4,878,507 | 11/1989 | Case et al. | 131/360 X |
| 4,911,181 | 3/1990 | Vromen et al. . | |
| 4,917,120 | 4/1990 | Hill . | |
| 4,995,407 | 2/1991 | Kossiakoff et al. . | |
| 5,069,231 | 12/1991 | Rutherford . | |
| 5,070,891 | 12/1991 | Rutherford . | |
| 5,284,163 | 2/1994 | Knudsen et al. . | |
| 5,293,883 | 3/1994 | Edwards . | |

FOREIGN PATENT DOCUMENTS

| | | |
|---|---|---|
| 0 434 332 | of 1991 | European Pat. Off. . |
| 0 573 279 | of 1993 | European Pat. Off. . |
| 1 967 605 | 8/1967 | Germany . |
| 8 505 197 | 6/1987 | Germany . |
| OS 44 00 266 | 7/1995 | Germany . |
| 52494 | of 1967 | Luxembourg . |

OTHER PUBLICATIONS

Light Free Product made by Ultratech—See Applicants' Information Disclosure Statement filed Feb. 10, 1995.

*Primary Examiner*—John G. Weiss

[57] ABSTRACT

A cigarette substitute article comprises one or more rod segments made of a gathered web or filamentary tow material in which a flavorant is embedded in liquid or powder form or in a breakable flavorant-containing capsule. The components of the article are designed to be fabricated using conventional cigarette making and cigarette filter making machinery.

11 Claims, 1 Drawing Sheet

CIGARETTE SUBSTITUTE ARTICLE AND METHOD OF MAKING THE SAME

This is a continuation of application Ser. No. 08/344,197, filed on Nov. 23, 1994, now abandoned.

FIELD OF THE INVENTION

The present invention relates to a flavor delivery article and a method of making the same and more particularly to a cigarette substitute or alternative device that is provided with a flavorant or aromatic material that is organoleptically sensed by the user when air is drawn through the device in the manner of drawing on a cigarette.

BACKGROUND OF THE INVENTION

Cigarette substitutes are known that deliver a flavorant or aromatic to the user when drawn upon in the manner of a conventional cigarette. Such cigarette substitute devices are disclosed, for example, in U.S. Pat. Nos. 2,342,853; 3,347,231; 3,683,936; and 4,995,407. One difficulty associated with such devices is the capacity to retain the flavorant in the device over time and to release an effective amount of the flavorant to the user at the time of use.

One solution to this difficulty is described in the aforementioned U.S. Pat. No. 3,347,231 in which a frangible container filled with a liquid flavorant or aromatic material is embedded in a central bore in a cigarette-shaped cylindrical element made of folded absorbent paper. Several means are disclosed for breaking the frangible container and releasing the liquid therein to the surrounding absorbent paper.

In U.S. Pat. No. 4,995,407, a plurality of vapor-emitting thermoplastic beads are contained in a cigarette-shaped tube plugged at each end by a porous, hydrophobic plug or are embedded in the porous plugs or a porous filler material disposed between the plugs.

It is also known in the cigarette filter making art to inject a liquid flavorant or to deposit a flavor-emitting pellet in the filter tow as the filter is being formed. Apparatus for making such flavor-containing filters are disclosed, for example, in U.S. Pat. No. 4,862,905 and EP Publication No. 0 573 279, both assigned to the assignee of the present invention.

It would be desirable to employ conventional apparatus and methods for mass producing cigarettes and cigarette filters in the mass production of cigarette substitutes or alternatives. Moreover, it would be desirable to provide a cigarette substitute that has a long shelf life, is capable of effectively retaining and releasing a flavorant, and can be mass produced at a low cost.

SUMMARY OF THE INVENTION

The present invention is directed to a cigarette substitute or alternative article or device and a method of making the same. The cigarette substitute article has a design and construction suitable for manufacture on conventional cigarette making and/or cigarette filter making machinery. The cigarette substitute comprises a cigarette filter-type rod substrate made of a fibrous tow or a gathered web in one or two segments, overwrapped with a paper overwrap and, preferably, tipped with a conventional tipping paper so as to give the appearance of a conventional tobacco-filled cigarette. The rod substrate preferably has a pressure drop comparable to a conventional filtered or unfiltered cigarette. A flavorant or aromatic material is embedded in the fibrous tow or web either by liquid or powder injection or by insertion of a breakable capsule made of wax or gelatin.

The flavorant or aromatic material may be selected from any number of known artificial and natural materials, such as, for example, peppermint, spearmint, wintergreen, menthol, cinnamon, chocolate, coffee, tobacco, vanillin and the like. The flavor delivering cigarette substitute of the present invention is useful as a breath freshener, as well as a smokeless, nicotine free alternative or complementary product useful by cigarette smokers at places where smoking is prohibited.

In one embodiment of the invention, a gathered web of a polymeric material, such as a polypropylene web, or a filamentary tow material, such as cellulose acetate, polyester or polypropylene tow, is formed into a continuous rod on a conventional filter making machine and a flavorant in a liquid or powder form is injected continuously or intermittently into the web or tow at the garniture or bustle of the filter making apparatus prior to overwrapping the rod with paper. The overwrapped flavorant-containing rod may then be either (1) cut into individual rods of appropriate length which are preferably tipped at one end with a conventional cigarette filter tipping paper and packaged like cigarettes in conventional cigarette packaging machinery or (2) cut into individual rod segments of appropriate length, each of which is combined with a mouthpiece rod segment, such as a conventional cellulose acetate cigarette filter segment, then circumscribed with tipping paper to join the segments together and finally packaged like cigarettes in conventional cigarette packaging machinery.

In another embodiment of the invention, the flavorant material may be injected into the cellulose acetate tow of the filter mouthpiece and combined with a rod made of a web or filamentary tow containing no flavorant. In still other embodiments of the invention, instead of injecting a liquid or powder flavorant into the rod material at the garniture of the filter making machine, a breakable wax or gelatin capsule containing a liquid flavorant may be embedded in the rod material or mouthpiece of each cigarette substitute device. When flavor delivery is desired, the user simply squeezes the device at the location of the capsule to break it and release the flavorant into the surrounding rod material. In a variation of the foregoing embodiment, the breakable capsule may be replaced by a flavor-emitting pellet, such as, for example, the flavor-emitting pellets described in the aforesaid U.S. Pat. No. 4,862,905.

Advantageously, the present invention makes it possible to modify and use conventional cigarette making and cigarette filter making processes and apparatus to make a cigarette substitute that has an appearance, feel and pressure drop that is comparable to conventional cigarettes. The invention also contemplates the use of biodegradable materials for the rod material and/or the treatment of the rod materials to render them substantially biodegradable.

With the foregoing and other objectives, features and advantages of the invention that will become hereinafter apparent, the invention may be more clearly understood by reference to the following detailed description of the invention, the appended claims and the several views illustrated in the drawings attached hereto.

DETAILED DESCRIPTION OF THE INVENTION

Figure 1:
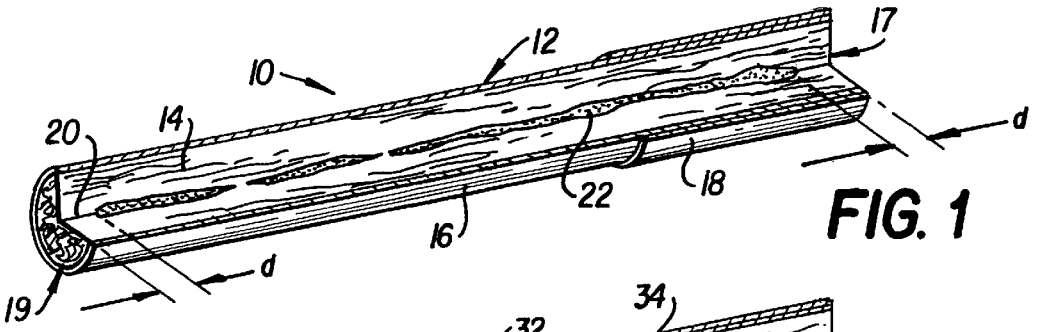
FIGS. 1–6 are partly sectioned perspective views of six embodiments of the flavor delivering cigarette substitute of the present invention.

Referring first to FIG. 1, there is shown in perspective a partially sectioned cigarette substitute device 10 made according to the present invention. Device 10 comprises an elongated cylindrical rod 12 made of a gathered web or filamentary tow substrate 14, such as a gathered paper or polymeric (polypropylene) web, a cellulose acetate, polypropylene, or polyester tow, according to conventional cigarette filter making processes. The rod 12 is circumscribed with an overwrap paper 16 which may be a conventional cigarette wrapping paper, such as 646 grade paper, and tipped at one end 17 (the mouth end) with a conventional cigarette tipping paper 18. In the manufacture of cigarettes, tipping paper 18 is ordinarily used to combine a tobacco rod with a filter and is often printed so as to give it a cork-like appearance. Although it should be understood that the dimensions of the rod 12 may vary substantially, one example of a suitably dimensioned device 10 has a rod length of about 78 mm from the upstream end 19 to the mouth end 17 with a circumference of about 25 mm. The length of the cigarette substitute is preferably about 40 mm or greater with a preferred length range of from about 40 mm to about 120 mm with a circumference range of about 20 mm to about 40 mm.

Disposed along the longitudinal axis 20 of the rod 12 is a flavorant or aromatic material 22, preferably in the form of a liquid or powder which has been injected along the axis 20 of the rod during formation of a continuous rod from which the rod 12 is cut. The continuous rod is preferably formed in the garniture of a conventional cigarette filter making machine. In the embodiment of FIG. 1, the material 22 may be injected along the axis 20 in intermittent cycles timed with the rod cut-off mechanism (not shown) of the filter making apparatus. In this way, the flavorant material 22 may be spaced from each end of the rod 12 a distance d in the range of 5 mm to 25 mm so that it does not come in direct contact with the mouth of the user. Intermittent injection may also be desirable if the flavorant material is colored so as to avoid staining the mouth end of the device prior to use.

It is, of course, possible to inject the material 22 into the rod continuously so that the material 22 extends from end to end of the rod 12. This may be desirable, for example, when the flavorant material is colorless or requires more direct contact with the taste buds of the user to achieve the desired organoleptic effect. It will be appreciated by those skilled in the art that by appropriate timing of the flavorant injection and cutting cycles of the filter rod making apparatus, the flavorant material may be positioned at any one or more axial location or locations along the axis 20 of rod 12 and may have any desired length or lengths along such axis.

In one preferred form, the rod substrate 14 is made of a gathered polypropylene web which provides a firmer rod having greater resistance to chewing by the user than cellulose acetate. Moreover, many flavorants are less absorbed by polypropylene than cellulose acetate and therefore transfer the flavorant more efficiently to the air drawn through the cigarette substitute article than does cellulose acetate.

Polyester filamentary tow is another material that may be advantageously used as the rod substrate 14. The polyester has in its filamentary tow form a feel similar to conventional cellulose acetate filters. Moreover, the flavorant is not well absorbed by the polyester material and, like the polypropylene web, transfers the flavorant more efficiently to the air drawn through the rod of the cigarette substitute device.

Cellulose acetate tow may also be used as the rod substrate 14. Although it has some disadvantages as described above, it has the advantages that it is a familiar material to cigarette smokers in terms of appearance and feel and is less expensive and easier to use than the polypropylene web or other tow materials.

To use the cigarette substitute article 10 of FIG. 1, no activation of the flavorant is necessary. The article 10 is simply removed from its conventional package in the same manner as a cigarette and the mouth end 17 is drawn on by the user to cause ambient air to flow through the rod from the upstream end 19 to the mouth end 17. As the air flows over the flavorant or aromatic material 22, it carries along vapors emitted from the material 22 which are organoleptically sensed by the user.

Figure 2:
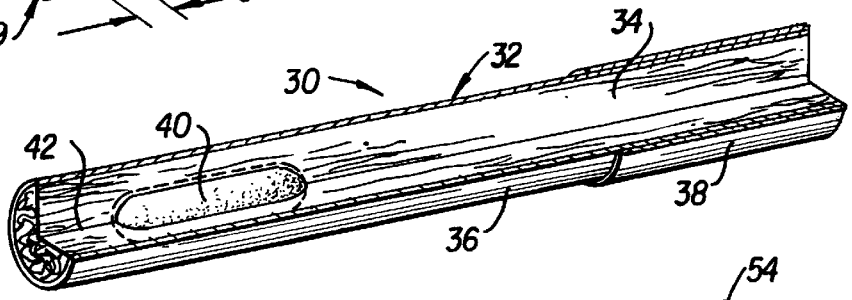

Referring now to FIG. 2, there is shown a second embodiment of the cigarette substitute article of the invention which is designated generally by reference numeral 30. Article 30 is the same in all respects as article 10 of FIG. 2 with the exception of the flavorant material. Cigarette substitute 30 comprises a rod 32 made of a gathered web or filamentary tow substrate 34 circumscribed by a paper overwrap 36 and tipped with a conventional cigarette tipping paper 38. Instead of injecting a flavorant in a liquid or powder form into the substrate, capsules 40 containing a liquid flavorant are inserted into the continuous rod substrate 34 at spaced intervals such that when the rod 32 is cut into individual articles 30, one or more capsules is embedded along the axis 42 of the rod 32.

Capsule 40 is preferably made of a breakable biodegradable material, such as gelatin, but may be made of other breakable materials such as wax or the like. The volume of the capsule 40 may vary depending on the quantity of liquid flavorant necessary to achieve the desired organoleptic effect. Storage of the flavorant liquid in the capsule 40 substantially increases the shelf life of the cigarette substitute article. To use the device 30 of FIG. 2, the rod 32 is grasped and squeezed between the fingers at the location of the capsule 40 until the capsule ruptures or breaks and releases the flavorant into the rod substrate. Thereafter, the device is used in the same way as the device 10.

Advantageously, the less expensive cellulose acetate tow is the preferred rod substrate 34 in the FIG. 2 embodiment since the device is used substantially concurrently with release of the flavorant. Typically, loss of flavorant by volatilization or by absorption into the substrate occurs over an extended period of time and is therefore of no concern in the FIG. 2 embodiment.

Figure 3:
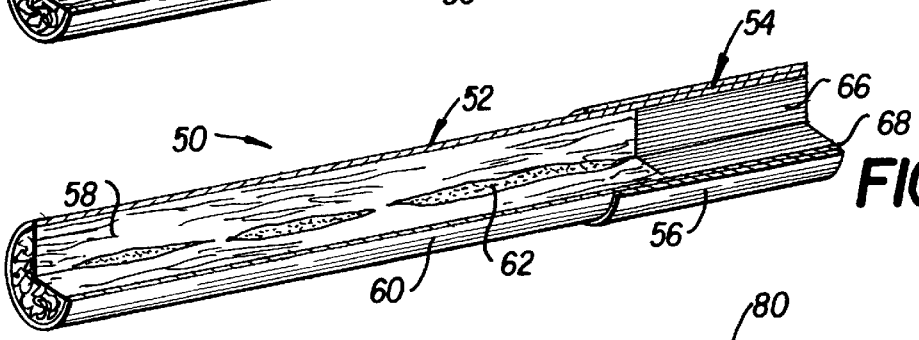

FIG. 3 illustrates a third embodiment of the invention in which a cigarette substitute article 50 is formed as two rod segments 52, 54 connected together by tipping paper 56 in the same way that a filter is joined to a tobacco rod in conventional cigarette making machinery. Rod 52 may be formed identically as rod 12 of the FIG. 1 embodiment with a rod substrate 58 circumscribed by a cigarette paper 60 with a liquid or powder flavorant 62 injected along the axis 64 thereof. Rod 54 is preferably made on conventional machinery from a cellulose acetate filter tow 66 overwrapped by a plug wrap 68. One advantage of the FIG. 3 embodiment is that the filter rod 54 has the same feel and appearance as the filter rod of a conventional cigarette.

Figure 4:
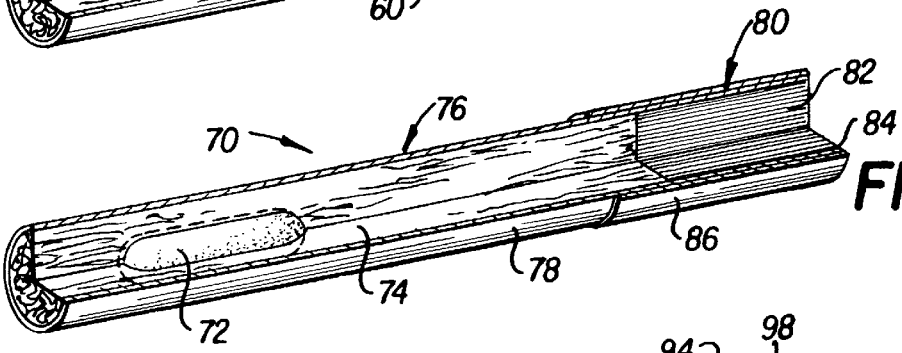

The FIG. 4 embodiment of the cigarette substitute article 70 has the same structure as the FIG. 3 embodiment except that the flavorant is added in the form of a flavorant-filled breakable capsule 72 embedded in the rod substrate 74 of the rod segment 76 overwrapped with cigarette paper 78. Rod segment 80 is identical to rod segment 54 and comprises a cellulose acetate tow 82 overwrapped by a plug wrap 84. Rod segments 76, 80 are joined by tipping paper 86 and the article 70 is used in the same manner as article 30 of FIG. 2.

Figure 5:
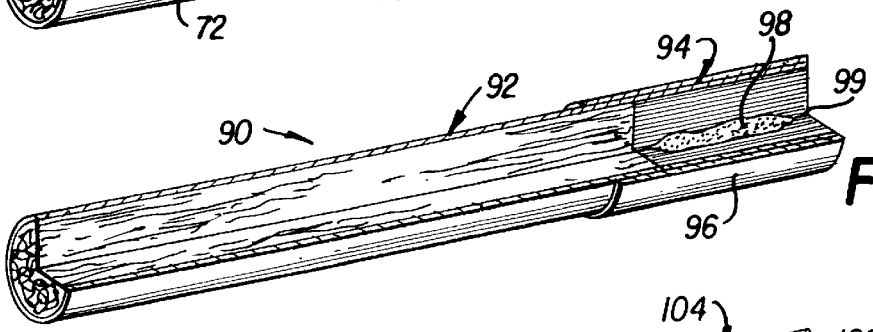
Figure 6:
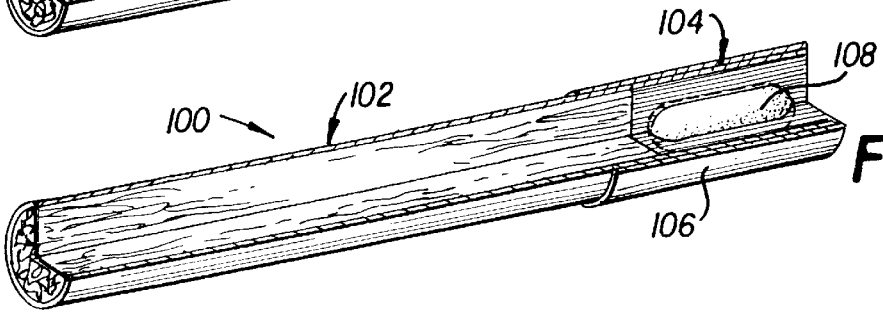

FIGS. 5 and 6 illustrate two additional embodiments of the invention which are similar to the embodiments of FIGS. 3 and 4 except that the flavorant is incorporated into the mouth end rod segment of the article rather than the upstream rod segment. The cigarette substitute article 90 of FIG. 5 comprises two rod segments 92, 94 joined together by tipping paper 96 in a conventional manner. A flavorant 98 in liquid or powder form is embedded in the mouth end rod segment 94 along the axis 99 thereof as described above. The cigarette substitute article 100 of FIG. 6 comprises two rod segments 102, 104 joined together by tipping paper 106. A flavorant-filled breakable capsule 108 is embedded in the mouth end segment 104 as described above, and is used in the same manner as the capsule 40 of FIG. 2.

As shown in FIGS. 1, 3 and 5, the flavorant is injected only along the longitudinal axis of the cigarette substitute in a relatively small cross-sectional area, rather than throughout the entire cross-sectional area of the web or tow substrate 14, 58, 94.

It will be appreciated that the present invention provides an efficient and economical way of mass producing a cigarette substitute article using existing cigarette making and cigarette filter making machinery. The several embodiments of the article are novel combinations of components and materials especially suited to provide effective transfer of the flavorant to the airstream passing through the cigarette substitute article so as to achieve the desired organoleptic effect.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

We claim:

1. A smokeless cigarette substitute comprising a filter rod having a transverse cross-sectional area and a longitudinal axis, said rod having two ends and being made of a gathered web or filamentary tow extending from end to end of said rod and across the entire transverse cross-sectional area of said rod, said rod having a length greater than about 40 mm and being overwrapped with paper, a flavorant disposed in direct contact with said web or tow only along the axis of said rod and between the ends thereof, said flavorant being in the form of a liquid or powder injected along the axis of said rod, the transverse cross-sectional area of the flavorant being substantially smaller than the transverse cross-sectional area of the rod and confined to a central portion of the transverse cross-sectional area of the rod such that said flavorant is in non-contacting relation with the paper overwrapping the rod, said flavorant being selected from the group consisting of peppermint, spearmint, wintergreen, menthol, cinnamon, chocolate, coffee and vanillin.

2. The cigarette substitute of claim 1, wherein said filter rod has a length in the range of about 40 mm to about 120 mm.

3. The cigarette substitute of claim 1, wherein said filter rod is made of a gathered polymeric web.

4. The cigarette substitute of claim 3, wherein said rod is made of a gathered polypropylene web.

5. The cigarette substitute of claim 1, wherein said filter rod is made of a polyester tow.

6. The cigarette substitute of claim 1, wherein said filter rod is made of a cellulose acetate tow.

7. The cigarette substitute of claim 1, including a tipping paper overwrapping said paper at one end of said rod.

8. The cigarette substitute of claim 1, including a rod segment having a longitudinal length less than said filter rod, said rod segment being devoid of flavorant and including tipping paper connecting said rod segment and filter rod in end to end relation.

9. A method of making a smokeless cigarette substitute article comprising the steps of:

forming a continuous rod of a gathered web or filamentary tow material on a cigarette filter rod maker having a garniture, said rod having a longitudinal axis and a cross-sectional area, the gathered web or filamentary tow material extending across the entire cross-sectional area of said rod;

continuously injecting a flavorant in the form of a liquid or a powder into said rod at the garniture of said maker, said flavorant being injected only along the longitudinal axis of said rod such that said flavorant is confined to a central portion of said rod and is in direct contact with the web or tow material, said flavorant being selected from the group consisting of peppermint, spearmint, wintergreen, menthol, cinnamon, chocolate, coffee and vanillin;

overwrapping said rod with a paper wrap at said garniture such that said paper wrap is in non-contacting relation with said flavorant;

cutting said continuous rod into individual cigarette substitute rods of a predetermined length in the range of 40 mm to 120 mm such that the injected flavorant extends from end to end of each individual rod; and packing said individual cigarette substitute rods in a package.

10. The method of claim 9, including the step of wrapping tipping paper about one end of each individual rod on a cigarette tipping apparatus.

11. The method of claim 10, including the steps of combining a further filter rod segment with said individual rod and attaching said further filter rod segment to said individual rod with said tipping paper.

* * * * *